US009837207B2

(12) United States Patent
Sagawa et al.

(10) Patent No.: US 9,837,207 B2
(45) Date of Patent: Dec. 5, 2017

(54) METHOD FOR PRODUCING NDFEB SYSTEM SINTERED MAGNET

(71) Applicant: INTERMETALLICS CO., LTD., Nakatsugawa-shi, Gifu (JP)

(72) Inventors: Masato Sagawa, Kyoto (JP); Tetsuhiko Mizoguchi, Kyoto (JP); Yasuhiro Une, Nagoya (JP)

(73) Assignee: INTERMETALLICS CO., LTD., Nakatsugawa-shi (JP)

( * ) Notice: Subject to any disclaimer, the term of this patent is extended or adjusted under 35 U.S.C. 154(b) by 504 days.

(21) Appl. No.: 14/397,564

(22) PCT Filed: Jun. 27, 2013

(86) PCT No.: PCT/JP2013/067677

§ 371 (c)(1),
(2) Date: Oct. 28, 2014

(87) PCT Pub. No.: WO2014/017249

PCT Pub. Date: Jan. 30, 2014

(65) Prior Publication Data

US 2015/0125336 A1 May 7, 2015

(30) Foreign Application Priority Data

Jul. 24, 2012 (JP) ..... 2012-164206

(51) Int. Cl.
*B22F 3/16* (2006.01)
*H01F 41/02* (2006.01)
(Continued)

(52) U.S. Cl.
CPC ..... *H01F 41/0266* (2013.01); *B22F 3/10* (2013.01); *B22F 3/16* (2013.01); *C22C 14/00* (2013.01);
(Continued)

(58) Field of Classification Search
CPC ..... B22F 2201/013; B22F 2201/016; B22F 2201/02; B22F 2201/10; B22F 2201/11;
(Continued)

(56) References Cited

U.S. PATENT DOCUMENTS 6,187,259 B1 2/2001 Yamashita et al.
7,056,393 B2 * 6/2006 Tokuhara ..... H01F 1/0573 148/101
(Continued)

FOREIGN PATENT DOCUMENTS

CN 1157051 A 8/1997
CN 1969347 A 5/2007
(Continued)

OTHER PUBLICATIONS

Jul. 20, 2015 Extended Search Report issued in European Patent Application No. 13822695.6.
(Continued)

*Primary Examiner* — Scott Kastler
*Assistant Examiner* — Vanessa T Luk
(74) *Attorney, Agent, or Firm* — Oliff PLC

(57) ABSTRACT

A method for producing a NdFeB system sintered magnet. The method includes: a hydrogen pulverization process, in which coarse powder of a NdFeB system alloy is prepared by coarsely pulverizing a lump of NdFeB system alloy by making this lump occlude hydrogen; a fine pulverization process, in which fine powder is prepared by performing fine pulverization for further pulverizing the coarse powder; a filling process, in which the fine powder is put into a filling container; an orienting process, in which the fine powder in the filling container is oriented; and a sintering process, in which the fine powder after the orienting process is sintered as held in the filling container. The processes from hydrogen pulverization through orienting are performed with neither
(Continued)

dehydrogenation heating nor evacuation each for desorbing hydrogen occluded in the hydrogen pulverization process. The processes from hydrogen pulverization through sintering are performed in an oxygen-free atmosphere.

2 Claims, 3 Drawing Sheets

(51) Int. Cl.

| | |
|---|---|
| ***H01F 1/057*** | (2006.01) |
| ***C22C 14/00*** | (2006.01) |
| ***C22C 38/00*** | (2006.01) |
| ***C22C 38/02*** | (2006.01) |
| ***C22C 38/10*** | (2006.01) |
| ***C22C 38/16*** | (2006.01) |
| ***C22C 33/02*** | (2006.01) |
| ***B22F 3/10*** | (2006.01) |
| ***H01F 1/053*** | (2006.01) |
| ***H01F 1/08*** | (2006.01) |

(52) U.S. Cl.
CPC ..... *C22C 33/02* (2013.01); *C22C 38/001* (2013.01); *C22C 38/005* (2013.01); *C22C 38/02* (2013.01); *C22C 38/10* (2013.01); *C22C 38/16* (2013.01); *H01F 1/0536* (2013.01); *H01F 1/0573* (2013.01); *H01F 1/086* (2013.01); *H01F 41/026* (2013.01); *B22F 2998/10* (2013.01); *C22C 2202/02* (2013.01); *H01F 1/0577* (2013.01)

(58) Field of Classification Search
CPC ..... B22F 2201/12; B22F 2201/20; B22F 2301/355; B22F 2998/00; B22F 2998/10; B22F 2999/00; C22C 2202/02; H01F 1/057; H01F 1/0571; H01F 1/0572; H01F 1/0573; H01F 1/0574; H01F 1/0575; H01F 1/0576; H01F 1/0577; H01F 1/0578; H01F 1/0579; H01F 1/0536; H01F 1/086; H01F 41/026; H01F 41/0266; H01F 41/0293
See application file for complete search history.

(56) References Cited

U.S. PATENT DOCUMENTS

| | | | | |
|---|---|---|---|---|
| 9,028,624 | B2 * | 5/2015 | Sagawa | B22F 1/0011 148/101 |
| 2004/0020563 | A1 | 2/2004 | Tokuhara et al. | |
| 2009/0252865 | A1 | 10/2009 | Sagawa | |
| 2010/0310408 | A1 * | 12/2010 | Nagata | B22F 3/02 419/38 |
| 2013/0189426 | A1 | 7/2013 | Sagawa | |

FOREIGN PATENT DOCUMENTS

| | | | | |
|---|---|---|---|---|
| CN | 101517670 | A | | 8/2009 |
| CN | 102498531 | A | | 6/2012 |
| CN | 102842420 | A | | 12/2012 |
| CN | 103503087 | A | | 1/2014 |
| DE | 69633490 | T2 | | 2/2005 |
| EP | 0778594 | A1 | | 6/1997 |
| EP | 1 164 599 | A2 | | 12/2001 |
| EP | 2071597 | A1 | | 6/2009 |
| EP | 2 693 450 | A1 | | 2/2014 |
| EP | 2 693 451 | A1 | | 2/2014 |
| EP | 2 800 108 | A1 | | 11/2014 |
| JP | H0917674 | A | | 1/1997 |
| JP | 2006019521 | A | | 1/2006 |
| JP | 2006274306 | A | * | 10/2006 |
| JP | 2007134353 | A | | 5/2007 |
| JP | 2007234953 | A | * | 9/2007 |
| JP | 2012079726 | A | | 4/2012 |
| JP | 5400255 | B1 | | 1/2014 |
| KR | 20090074767 | A | | 7/2009 |
| RU | 2009114155 | A | | 10/2010 |
| TW | 200823935 | A | | 6/2008 |
| WO | 1997001855 | A1 | | 1/1997 |
| WO | 2006043348 | A1 | | 4/2006 |
| WO | 2008032426 | A1 | | 3/2008 |
| WO | 2011004894 | A1 | | 1/2011 |
| WO | 2013/100008 | A1 | | 7/2013 |

OTHER PUBLICATIONS

Popov, A. G. et al., "Preparation of Sintered Nd—Fe—B Magnets by Pressless Process", The Physics of Metals and Metallography, Apr. 17, 2012, vol. 113, No. 4, pp. 331-340.
Feb. 29, 2016 First Office Action issued in Chinese Patent Application No. 201380039498.6.
Oct. 1, 2013 Search Report issued in International Application No. PCT/JP2013/067677.
Harris, Rex et al. "Rare Earth Magnets", [online], dated Aug. 7, 2001, [searched on Jul. 17, 2012], Internet.
Jan. 27, 2015 International Preliminary Report on Patentability issued in International Application No. PCT/JP2013/067677.
Sep. 10, 2015 Office Action issued in Korean Patent Application No. 10-2014-7032439.
Mar. 28, 2017 Office Action issued in Japanese Patent Application No. 2014-526830.
Jan. 20, 2017 Office Action issued in Chinese Patent Application No. 201380039498.6.

* cited by examiner

METHOD FOR PRODUCING NDFEB SYSTEM SINTERED MAGNET

TECHNICAL FIELD

The present invention relates to a method for producing a NdFeB (neodymium-iron-boron) system sintered magnet. A "NdFeB system magnet" is a magnet containing $Nd_2Fe_{14}B$ as the main phase. However, the magnet is not limited to the magnet which contains only Nd, Fe and B; it may additionally contain a rare-earth element other than Nd as well as other elements, such as Co, Ni, Cu or Al. The method for producing a NdFeB system sintered magnet according to the present invention includes both the method for producing a base material necessary for performing a process using the grain boundary diffusion method which will be described later (such a process is hereinafter called the "grain boundary diffusion process") and the method for producing a product to be directly used as a magnet, without performing the grain boundary diffusion process.

BACKGROUND ART

NdFeB system sintered magnets were discovered in 1982 by Sagawa (one of the present inventors) and other researchers. The magnets exhibit characteristics far better than those of conventional permanent magnets and can be advantageously manufactured from Nd (a kind of rare-earth element), iron and boron, which are relatively abundant and inexpensive materials. Hence, NdFeB system sintered magnets are used in a variety of products, such as driving motors for hybrid or electric cars, battery-assisted bicycle motors, industrial motors, voice coil motors used in hard disk drives and other apparatuses, high-grade speakers, headphones, and permanent magnetic resonance imaging systems. NdFeB system sintered magnets used for those purposes must have a high coercive force $H_{cJ}$ and a high maximum energy product $(BH)_{max}$.

It has been known that the coercive force of NdFeB system sintered magnets can be improved by making Dy, Tb or other heavy rare-earth elements $R_H$ present inside the magnet, since those elements make reverse magnetic domains less likely to develop when a magnetic field opposite to the direction of magnetization is applied. The reverse magnetic domain has the characteristic that it initially develops in a surface region of a main phase grain and then spreads into inner regions as well as over the neighboring main phase grains. Therefore, to prevent the initial development of the reverse magnetic domain, $R_H$ only needs to be present in the surface region of the main phase grain, whereby the development of the reverse magnetic domain on the surface of the main phase grain can be prevented. However, an increase in the $R_H$ content lowers the residual magnetic flux density Br, which leads to a decrease in the maximum energy product $(BH)_{max}$. Accordingly, to increase the coercive force (i.e. to make the reverse magnetic domain less likely to develop) while minimizing the decrease in the maximum energy product $(BH)_{max}$, it is desirable to make $R_H$ present at higher concentrations in the surface region of the main phase grain than in the inner regions.

One method for making $R_H$ present in a NdFeB system sintered magnet is a "single alloy method", in which $R_H$ is added to a starting alloy in the step of preparing the alloy. Another method is a "binary alloy blending technique", in which a main phase alloy which does not contain $R_H$ and a grain boundary phase alloy to which $R_H$ is added are prepared as two kinds of starting alloy powder, which are subsequently mixed together and sintered. Still another method is a "grain boundary diffusion method", which includes the steps of preparing a NdFeB system sintered magnet as a base material, putting $R_H$ to the surface of the base material by application, deposition or another process, and heating the base material to diffuse $R_H$ from the surface of the base material into inner regions through the grain boundaries inside the base material (Patent Literature 1).

Among those methods, when the single alloy method is chosen, the starting alloy powder already contains $R_H$ uniformly distributed in its main phase grains, so that a sintered magnet created from this powder inevitably contains $R_H$ in the main phase grains. Therefore, the sintered magnet created by the single alloy method has a relatively low maximum energy product while it has a high coercive force. In the case of the binary alloy blending technique, the largest portion of $R_H$ will be held in the surface regions of the main phase grains. Therefore, as compared to the single alloy method, this technique can reduce the amount of decrease in the maximum energy product. Another advantage over the single alloy method is that the used amount of the rare metal $R_H$ is reduced.

In the case of the grain boundary diffusion method, $R_H$ attached to the surface of the base material is diffused into inner regions through the grain boundaries liquefied by heat in the base material. Since the diffusion rate of $R_H$ in the grain boundaries is much higher than the rate at which $R_H$ is diffused from the grain boundaries into the main phase grains, $R_H$ is promptly supplied into deeper regions of the base material. By contrast, the diffusion rate from the grain boundaries into the main phase grains is low, since the main phase grains remain in the solid state. Using this difference in the diffusion rate, the temperature and time of the heating process can be regulated so as to realize the ideal state in which the Dy or Tb concentration is high only in the vicinity of the surface of the main phase grains (grain boundaries) in the base material while the same concentration is low inside the main phase grains. Furthermore, since the heating temperature in the grain boundary diffusion process is lower than the sintering temperature, the melting of the main phase grains is less likely to occur than in the case of the binary alloy blending technique, so that the penetration of $R_H$ into the main phase grains is more effectively prevented than in the binary alloy blending technique. Therefore, the amount of decrease in the maximum energy product $(BH)_{max}$ can be made smaller than in the case of the binary alloy blending technique. Another advantage over the binary alloy blending technique is that the used amount of the rare metal $R_H$ is reduced.

There are two different methods for producing NdFeB system sintered magnets: a "press-applied magnet-production method" and a "press-less magnet-production method." In the press-applied magnet-production method, which is a conventionally and commonly used method, fine powder of a starting alloy (which is hereinafter called the "alloy powder") is placed in a mold, and a magnetic field is applied to the alloy powder while pressure is applied to the alloy powder with a pressing machine, whereby the creation of a compression-molded body and the orientation of the same body are simultaneously achieved. Then, the compression-molded body is removed from the mold and heated to be sintered. In the press-less magnet-production method, which has been discovered in recent years, alloy powder which has been put in a predetermined filling container is oriented and sintered as it is held in the filling container, without undergoing the compression molding (Patent Literature 2).

The press-applied magnet-production method requires a large-size pressing machine to create a green compact. Therefore, it is difficult to perform the processes from the filling through the sintering in a closed space. By contrast, the press-less magnet-production method has the advantage that it does not use a pressing machine and therefore allows the aforementioned processes to be performed in a closed space.

CITATION LIST

Patent Literature

Patent Literature 1: WO 2006/043348 A1
Patent Literature 2: JP 2006-019521 A
Patent Literature 3: WO 2011/004894 A1

Non Patent Literature

Non Patent Literature 1: Rex Harris and A. J. Williams, "Rare Earth Magnets", [online], dated Aug. 7, 2001, [searched on Jul. 17, 2012], Internet

SUMMARY OF INVENTION

Technical Problem

In the grain boundary diffusion method, the condition of the grain boundaries significantly affects the way the $R_H$, which is attached to the surface of the base material by deposition, application or another process, is diffused into the base material, such as how easily $R_H$ will be diffused and how deeply it can be diffused from the surface of the base material. One of the present inventors has discovered that a rare-earth rich phase (i.e. the phase containing rare-earth elements in higher proportions than the main phase grains) in the grain boundaries serves as the primary passage for the diffusion of $R_H$ in the grain boundary diffusion method, and that the rare-earth rich phase is preferred to continuously exist, without interruption, through the grain boundaries of the base material in order to diffuse $R_H$ to adequate depths from the surface of the base material (Patent Literature 3).

A later experiment conducted by the present inventors has revealed the following fact: In the production of a NdFeB system sintered magnet, an organic lubricant is added to the alloy powder to reduce the friction between the grains of the alloy powder and help the grains easily rotate in the orienting process as well as for other purposes. This lubricant contains carbon atoms, and a considerable portion of the carbon atoms remain inside the NdFeB system sintered magnet. Among the thus remaining carbon atoms, those which remain in the grain boundary triple point (a portion of the grain boundary surrounded by three or more main phase grains) are cohered together, forming a carbon rich phase (a phase whose carbon content is higher than the average of the entire NdFeB system sintered magnet) in the rare-earth rich phase. As already noted, the rare-earth rich phase existing in the grain boundaries serves as the primary passage for the diffusion of $R_H$ into the inner region of the NdFeB system sintered magnet. Conversely, the carbon rich phase formed in the rare-earth rich phase acts like a weir which blocks the $R_H$ diffusion passage and impedes the diffusion of $R_H$ through the grain boundary.

The problem to be solved by the present invention is to provide a method for producing a NdFeB system sintered magnet which can be used in the grain boundary diffusion method as a base material in which $R_H$ can be easily diffused through the rare-earth rich phase and which can thereby achieve a high coercive force. The present invention also provides a NdFeB system sintered magnet which is produced without the grain boundary diffusion process but has a high coercive force, as well as a method for producing such a magnet.

Solution to Problem

A method for producing a NdFeB system sintered magnet according to the present invention includes:

a) a hydrogen pulverization process, in which coarse powder of a NdFeB system alloy is prepared by coarsely pulverizing a lump of NdFeB system alloy by making this lump occlude hydrogen;

b) a fine pulverization process, in which fine powder is prepared by performing fine pulverization for further pulverizing the coarse powder;

c) a filling process, in which the fine powder is put into a filling container;

d) an orienting process, in which the fine powder as held in the filling container is oriented; and e) a sintering process, in which the fine powder after the orienting process is sintered as held in the filling container, wherein:

the processes from the hydrogen pulverization process through the orienting process are performed with neither dehydrogenation heating nor evacuation each for desorbing hydrogen occluded in the hydrogen pulverization process; and the processes from the hydrogen pulverization process through the sintering process are performed in an oxygen-free atmosphere.

Some terms used in the present application are hereinafter described.

The "dehydrogenation heating" is, as already noted, a heating process aimed at desorbing hydrogen occluded in the coarse or fine powder of a NdFeB system alloy in the hydrogen pulverization process. This heating process must be distinguished from the heating process for sintering the fine powder of the NdFeB system alloy. In general, dehydrogenation heating is performed at a temperature lower than the temperature for the sintering.

The "evacuation" is a process for reducing a gas pressure to a level lower than the atmospheric pressure. Common types of vacuum apparatuses can be used for the evacuation, such as a rotary pump, a diaphragm pump, a dry pump, and a turbomolecular pump.

The "lump of NdFeB system alloy" is an object made of a NdFeB system alloy with a size larger than the coarse or fine powder of the NdFeB system alloy. A typical example of a lump of NdFeB system alloy is a piece of NdFeB system alloy sheet prepared by strip casting. Other kinds of massive objects made of a NdFeB system alloy are also included. The "NdFeB system alloy" may contain a rare-earth element other than Nd as well as other elements, such as Co, Ni and Al, in addition to the three elements Nd, Fe and B.

The "fine pulverization" is a process for pulverizing the coarse powder obtained through hydrogen pulverization of a lump of NdFeB system alloy. Commonly known method for fine pulverization can be used, such as the jet mill or ball mill method. In the present invention, if the pulverization process is performed in multiple stages after the hydrogen pulverization, those multiple-stage pulverization processes should entirely be included in the "fine pulverization."

As explained earlier, the press-applied magnet-production method and the press-less magnet-production method have been known as the methods for producing NdFeB system sintered magnets. In the conventional press-applied magnet-production method, the dehydrogenation heating for desorbing hydrogen has been performed for two reasons: The first reason is that an alloy powder containing hydrogen compounds is easy to be oxidized, and if dehydrogenation is not performed, the hydrogen compounds resulting from the occlusion of hydrogen by the $Nd_2Fe_{14}B$ or rare-earth element contained in the alloy lump become oxidized, which deteriorates the magnetic properties of the magnet obtained as the product. The second reason is that, if dehydrogenation is not performed, the hydrogen desorbs spontaneously or due to the heat during the sintering after the molding process, which may cause the hydrogen to turn into molecules, gasify and expand inside the green compact before this compact is completely sintered, with the result that the green compact is broken.

Such a dehydrogenation process used in the press-applied magnet-production method has also been used in the conventional press-less magnet-production method in the same way.

The present inventors have reexamined each process in order to produce a NdFeB system sintered magnet having even higher magnetic properties. As a result, it has been revealed that, if the dehydrogenation heating is omitted and the fine powder (alloy powder) is left intact with hydrogen compounds contained in it, the lubricant added to the alloy powder before the orienting process (normally, in the process of putting the alloy powder into a filling container) or at any other appropriate stage will be removed by heat in the sintering process. This is probably because the lubricant is hydrocracked by the hydrogen gas generated by the heat and vaporized in the form of shorter carbon chains. Therefore, in the NdFeB system sintered magnet produced by the method according to the present invention, the carbon content and the volume ratio of the carbon rich phase are decreased to low levels, so that higher magnetic properties can be achieved. If a grain boundary diffusion process is performed using the thus obtained NdFeB system sintered magnet as a base material, $R_H$ can be diffused through the rare-earth rich phase in the grain boundaries to adequate depths inside the sintered body without being impeded by the carbon rich phase, so that a NdFeB system sintered magnet with an even higher level of coercive force can be obtained.

The dehydrogenation heating normally requires several hours. The method for producing a NdFeB system sintered magnet according to the present invention does not include dehydrogenation heating, and therefore, the period of time for this process can be omitted. That is to say, the present invention simplifies the production process, shortens the production time and reduces the production cost.

Another effect of the present invention is that the alloy powder containing hydrogen compounds resulting from the hydrogen occlusion is prevented from oxidization since the processes from the hydrogen pulverization through the sintering process are performed in an oxygen-free atmosphere. Furthermore, in the present invention, since the press-less magnet-production method is adopted, the problem of the breakage of green compacts due to the gasification and expansion of hydrogen does not occur as in the press-applied magnet-production method.

However, it should be noted that, when the evacuation is performed to create an oxygen-free atmosphere, the hydrogen may be desorbed from the alloy powder due to the evacuation. To avoid this situation, in the method for producing a NdFeB system sintered magnet according to the present invention, the evacuation is not performed from the hydrogen pulverization process through the orienting process. In this case, one example of the method for performing the fine pulverization process and the orienting process in an oxygen-free atmosphere is to fill the space around the alloy powder with inert gas, such as nitrogen or argon. Using a noble gas is particularly preferable.

It is preferable to not perform the evacuation in the sintering process at least from the beginning of the heating-up until the temperature reaches a predetermined temperature equal to or lower than the sintering temperature. The reason is as follows:

It is generally known that, when a NdFeB system alloy which has occluded hydrogen is heated, a portion of the hydrogen occluded in the main phase or bonded to the rare-earth rich phase is desorbed at temperatures within a range from room temperature to 400° C. (see Non Patent Literature 1). The hydrogen gas thus desorbed is capable of hydrocracking the lubricant and promoting the vaporization of the lubricant. If the lubricant were allowed to remain at temperatures higher than 500° C., the NdFeB system alloy would react with the lubricant and the carbon content in the alloy would increase.

Not performing the evacuation from the beginning of the heating-up until the temperature reaches the predetermined temperature has the effect of allowing the hydrogen gas generated from the alloy to be in contact with the lubricant for a longer period of time, which enables the hydrocracking to be efficiently and adequately performed, so that the NdFeB system sintered magnet will have a lower carbon content. The predetermined temperature is typically set within a range from 100° C. to 400° C., where desorption of hydrogen occurs. After this hydrogen desorption temperature is reached, it is preferable to perform the evacuation in order to increase the sintered density of the magnet.

Furthermore, according to the present invention, since hydrogen can be distributed throughout the alloy lump, the particles of the coarse powder will be finer and more fragile, so that the fine pulverization can proceed at higher rates and the production efficiency will thereby be improved.

Advantageous Effects of the Invention

With the method for producing a NdFeB system sintered magnet according to the present invention, a NdFeB system sintered magnet which has a low carbon content and therefore has high magnetic properties can be obtained. If a grain boundary diffusion process is performed using the thus obtained NdFeB system sintered magnet as a base material, $R_H$ can be diffused through the rare-earth rich phase in the grain boundaries to adequate depths inside the sintered body without being impeded by the carbon rich phase, so that a NdFeB system sintered magnet with a high coercive force can be obtained. Various other effects can also be obtained, such as the simplification of the production process, the shortening of the production time and the reduction in the production cost.

DESCRIPTION OF EMBODIMENTS

One embodiment of the method for producing a NdFeB system sintered magnet according to the present invention is hereinafter described.

Figure 1:
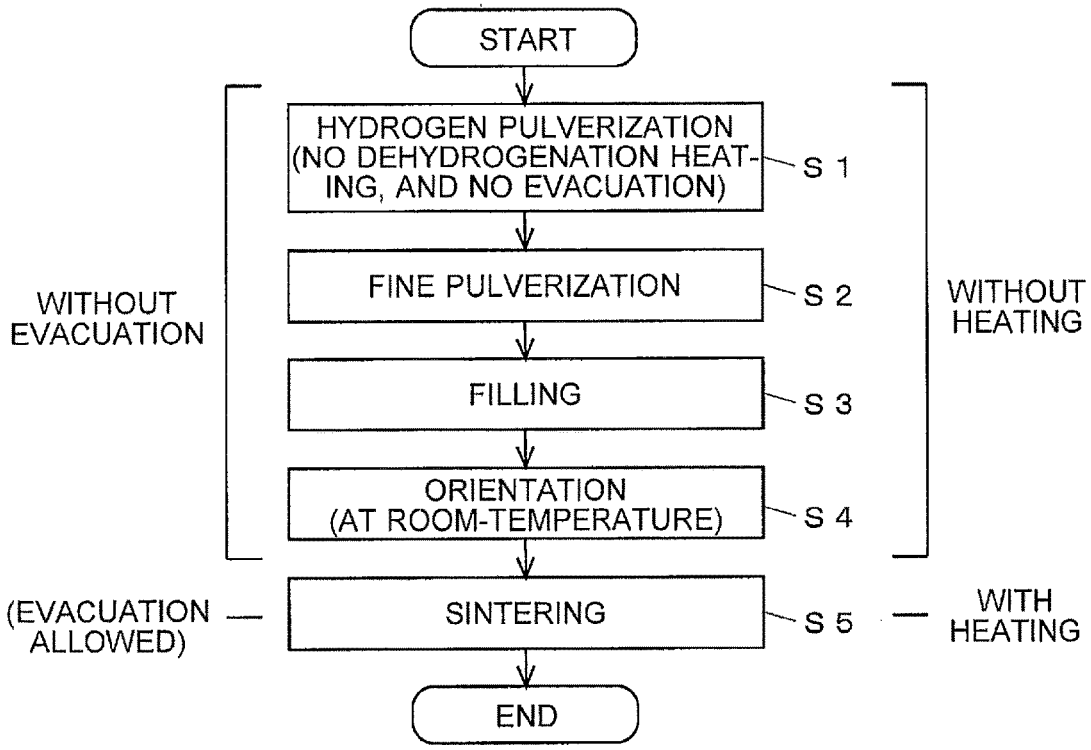
FIG. 1 is a flowchart showing one embodiment of the method for producing a NdFeB system sintered magnet according to the present invention.

As shown in FIG. 1, the method for producing a NdFeB system sintered magnet according to the present embodiment includes: a hydrogen pulverization process (Step S1), in which a piece or pieces of alloy sheets of a NdFeB system alloy prepared beforehand by strip casting is coarsely pulverized by making the alloy sheet occlude hydrogen; a fine pulverization process (Step S2), in which 0.05-0.1 wt % of methyl caprylate or similar lubricant is mixed in the coarse powder of the NdFeB system alloy prepared by hydrogen pulverization of the NdFeB system alloy sheet in the hydrogen pulverization process without the subsequent dehydrogenation heating, and in which the coarse powder is finely pulverized in a nitrogen gas stream using a jet mill so that the grain size of the alloy will be equal to or smaller than 3.2 μm in terms of the median ($D_{50}$) of the grain size distribution measured by a laser diffraction method; a filling process (Step S3), in which 0.05-0.15 wt % of methyl laurate or similar lubricant is mixed in the finely pulverized powder (alloy powder) and the mixture is put in a mold (filling container) at a density of 3.0-3.5 g/cm$^3$; an orienting process (Step S4), in which the alloy powder held in the mold is oriented in a magnetic field at room temperature; and a sintering process (Step S5), in which the oriented alloy powder in the mold is sintered.

The processes of Steps S3 through S5 are performed as a press-less process. Step S1 is performed in hydrogen gas without evacuation, and Steps S2 through S4 are performed in an inert gas without evacuation. An evacuation may be performed before Step S1 in order to prevent oxidization of the alloy as well as to prevent a detonating reaction of hydrogen and oxygen and thereby ensure safety. However, this is a pre-process to be performed before the hydrogen pulverization process is initiated. Step S5 in the present embodiment is initially performed in argon gas until the temperature being increased reaches 500° C. which is a halfway to the sintering temperature and subsequently performed in vacuum. Examples of the inert gas used in those steps include argon gas, helium gas and other kinds of noble gas, nitrogen gas, as well as a mixture of two or more of those kinds of gas.

Figure 2:
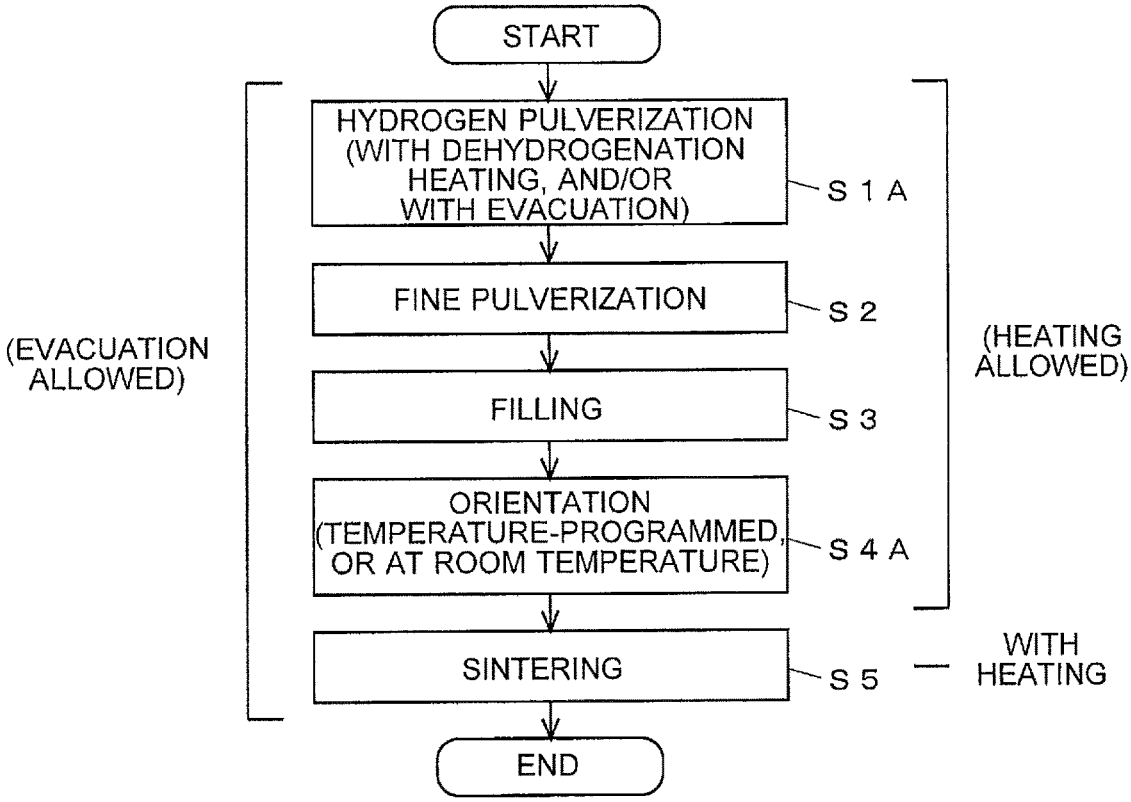
FIG. 2 is a flowchart showing a method for producing a NdFeB system sintered magnet as a comparative example.

For comparison, an example in which the dehydrogenation heating and/or evacuation is performed is described by means of FIG. 2. The production method in the present example is identical to the method shown by the flowchart in FIG. 1 except for the following two differences: The first difference is that the hydrogenation heating and/or evacuation for desorbing hydrogen is performed after the NdFeB system alloy is made to occlude hydrogen in the hydrogen pulverization process (Step S1A). More specifically, one of the three following operations is chosen in Step S1A: (i) the dehydrogenation heating is performed (without evacuation), (ii) the evacuation is performed (without dehydrogenation heating), and (iii) both the dehydrogenation heating and the evacuation are performed. The second difference is that, in the orienting process, the alloy powder may (optionally) be heated before or in the middle of the process of orienting the alloy powder in the magnetic field (Step S4A). Such an orientation process accompanied by heating is called the "temperature-programmed orientation." The temperature-programmed orientation is a technique for temporarily lowering the coercive force of each individual grain of the alloy powder to suppress the mutual repulsion of the grains in the orienting process so as to improve the degree of orientation of the eventually obtained NdFeB system sintered magnet in the case where an alloy powder having a high coercive force is used as in the present embodiment. This technique lowers the production efficiency since it includes heating and cooling processes. Therefore, the temperature-programmed orientation is not performed in the present embodiment.

Figure 3:
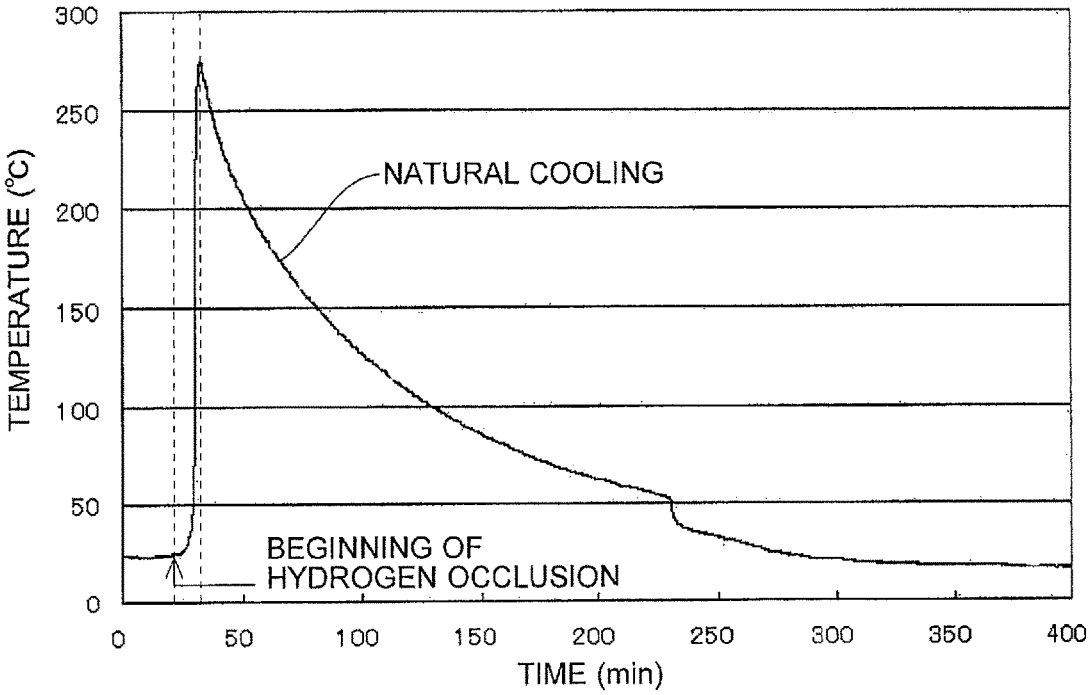
FIG. 3 is a graph showing a temperature history of the hydrogen pulverization process in the method for producing a NdFeB system sintered magnet of the present embodiment.
Figure 4:
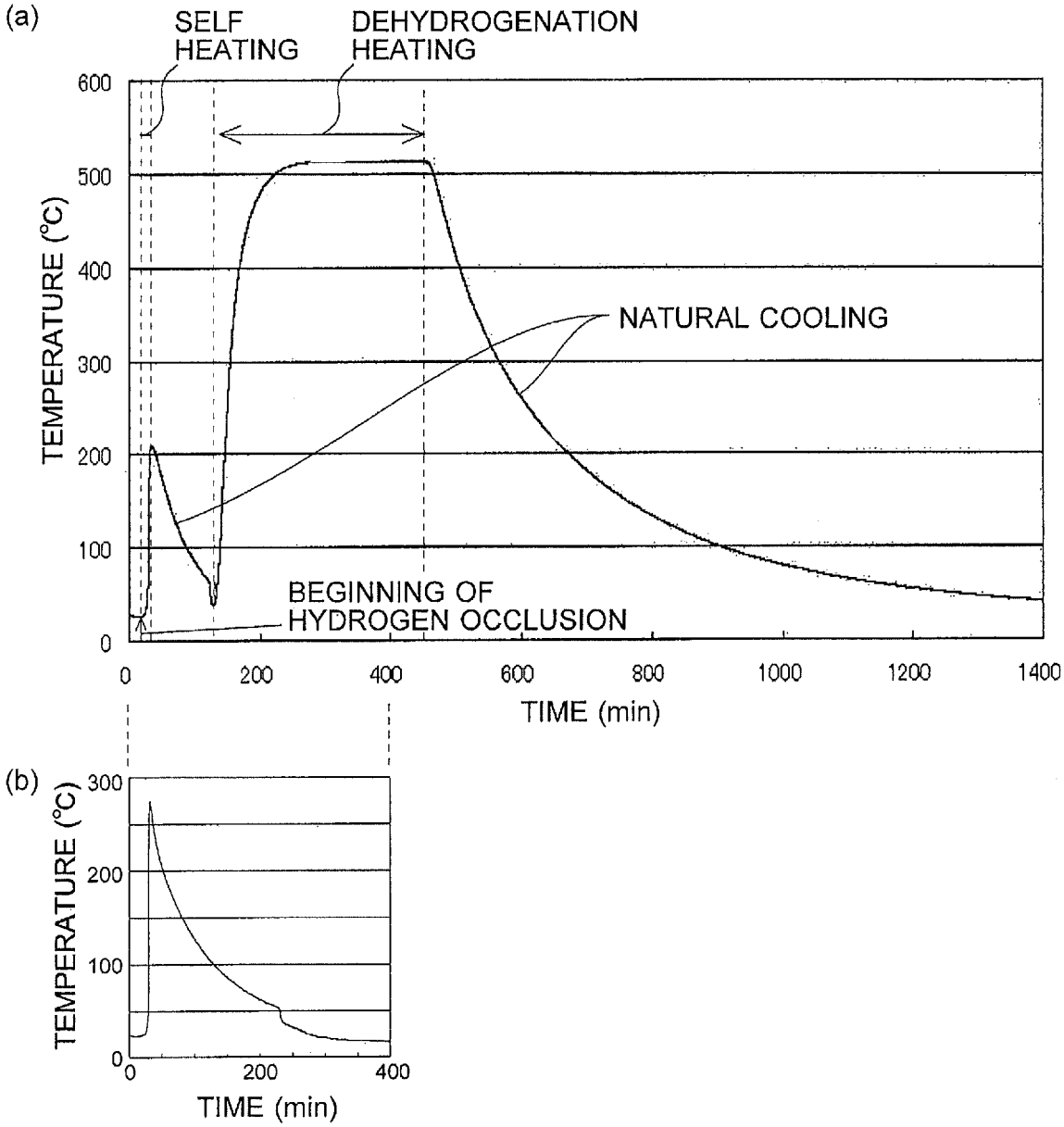
FIG. 4 is (a) a graph showing a temperature history of the hydrogen pulverization process in the comparative example of the method for producing a NdFeB system sintered magnet, and (b) a resized version of the graph in FIG. 3 fitted to the scale of graph (a) in FIG. 4.

The following description is focused on the dehydrogenation heating, leaving the evacuation out of consideration, to explain what difference occurs depending on whether or not the dehydrogenation heating is performed, using a temperature history of the hydrogen pulverization process. The graph in FIG. 3 is a temperature history of the hydrogen pulverization process in the method for producing a NdFeB system sintered magnet without dehydrogenation heating (Step S1, or case (ii) in Step S1A of the comparative example), while graph (a) in FIG. 4 is a temperature history of the hydrogen pulverization process in the method for producing a NdFeB system sintered magnet with dehydrogenation heating (case (i) or (iii) in Step S1A). Graph (b) in FIG. 4 is a resized version of the graph in FIG. 3 with the horizontal and vertical scales fitted to those of graph (a) in FIG. 4.

In the hydrogen pulverization process, the NdFeB system alloy lump is made to occlude hydrogen. The hydrogen occlusion process is an exothermic reaction and causes the NdFeB system alloy lump to self-heat to temperatures of 200° C. to 300° C. During this process, the Nd rich phase in the alloy lump reacts with hydrogen and expands, creating a large number of cracks, to eventually pulverize the lump. A portion of the hydrogen is also occluded in the main phase. In general, after being naturally cooled, the obtained powder is heated to approximately 500° C. to desorb a portion of the hydrogen which has reacted with the Nd rich phase (dehydrogenation heating), in order to suppress oxidization of the alloy, after which the powder is naturally cooled to room temperature. In graph (a) of FIG. 4, which shows the example with dehydrogenation heating, the period of time required for the hydrogen pulverization process is approximately 1,400 minutes, including the period of time for desorbing hydrogen.

In the case where the dehydrogenation heating is not performed, as shown in FIG. 3 and in graph (b) of FIG. 4, the hydrogen pulverization process can be completed within approximately 400 minutes after the temperature begins to rise due to the heat resulting from the hydrogen occlusion process, even if a somewhat long period of time is allotted for the cooling of the alloy powder to room temperature. As compared to the example (a) in FIG. 4, the production time can be reduced by approximately 1,000 minutes (16.7 hours). Thus, by omitting the dehydrogenation heating, the production process can be simplified and the production time can be significantly shortened.

Hereinafter described is the result of an experiment in which NdFeB system sintered magnets were actually created using the method of the present embodiment and that of the comparative example. The inert gases used in the present embodiment were nitrogen gas in the fine pulverization process (Step S2) and argon gas in the other processes. In the comparative example, neither the dehydrogenation heating in the hydrogen pulverization process (Step S1A) nor the temperature-programmed orientation in the orientation process (Step S4A) was performed, but the evacuation in the hydrogen pulverization process was performed (i.e., the method of the aforementioned case (ii) was adopted). A NdFeB system alloy lump with the same composition was used as the material in both the present embodiment and the comparative example. Specifically, the composition (in percent by weight) was as follows: Nd: 26.95, Pr: 4.75, Dy: 0, Co: 0.94, B: 1.01, Al: 0.27, Cu: 0.1, and Fe: balance.

The result of this experiment was such that the NdFeB system sintered magnet created in the comparative example had a coercive force of 17.6 kOe, while the NdFeB system sintered magnet created in the present embodiment had a higher coercive force, 18.1 kOe.

Another experiment was also conducted in which a grain boundary diffusion process was performed as follows using the NdFeB system sintered magnets created in the present embodiment and the comparative example as the base material.

Initially, a TbNiAl alloy powder composed of 92 wt % of Tb, 4.3 wt % of Ni and 3.7 wt % of Al was mixed with silicon grease by a weight ratio of 80:20. Then, 0.07 g of silicon oil was added to 10 g of the aforementioned mixture to obtain a paste, and 10 mg of this paste was applied to each of the two magnetic pole faces (7 mm×7 mm in size) of the base material.

After the paste was applied, the rectangular base material was placed on a molybdenum tray provided with a plurality of pointed supports. The rectangular base material, being held by the supports, was heated in a vacuum of $10^{-4}$ Pa. The heating temperature was 880° C., and the heating time was 10 hours. Subsequently, the base material was quenched to room temperature, after which it was heated at 500° C. for two hours and then once more quenched to room temperature. Thus, the grain boundary diffusion process was completed.

The result of this experiment of the grain boundary diffusion process was such that the NdFeB system sintered magnet created in the comparative example had a coercive force of 25.5 kOe, while the NdFeB system sintered magnet created in the present embodiment had a higher coercive force, 26.4 kOe.

Thus, it has been confirmed that a NdFeB system sintered magnet with higher magnetic properties can be obtained by omitting the evacuation as in the present embodiment.

Not only the magnetic properties but also the pulverization rate in the fine pulverization process was improved in the present embodiment. Specifically, in the case where coarse powder was pulverized to a mean grain size of 2 μm (in terms of the $D_{50}$ value measured by the laser method), the pulverization rate was 12 g/min in the comparative example, while the rate in the present embodiment was 21 g/min, an approximately 70% improvement. This is most likely due to the fact that the fine pulverization in the present embodiment is performed under the condition that a larger amount of hydrogen is occluded in the coarse powder, and particularly, that a considerable amount of hydrogen is occluded in the main phase. As described thus far, by omitting the evacuation for dehydrogenation, it becomes possible to shorten the period of time for the fine pulverization process which constitutes a temporal bottleneck in the mass production of NdFeB system sintered magnets, and to thereby enhance the production efficiency.

The invention claimed is:

1. A method for producing a NdFeB system sintered magnet, comprising:

a) coarsely pulverizing a lump of NdFeB system alloy by making the lump occlude hydrogen via a hydrogen pulverization process, in which coarse powder of the NdFeB system alloy is prepared;

b) finely pulverizing the coarse powder via a fine pulverization process, in which fine powder is prepared;

c) filling a filling container with the fine powder via a filling process;

d) orienting the fine powder held in the filling container via an orienting process; and e) sintering the fine powder in the filling container after the orienting process via a sintering process, and performing evacuation during the sintering process only after a predetermined temperature in a range of from 100 to 500° C. is reached such that evacuation is not performed during a beginning of the sintering process before the predetermined temperature is reached;

wherein:

the processes from the hydrogen pulverization process through the orienting process are performed with neither dehydrogenation heating nor evacuation each for desorbing hydrogen occluded in the hydrogen pulverization process; and the processes from the hydrogen pulverization process through the sintering process are performed in an oxygen-free atmosphere.

2. The method according to claim 1, wherein the predetermined temperature is within a range of from 100° C. to 400° C.

* * * * *